US009180718B1

(12) United States Patent
Soga et al.

(10) Patent No.: US 9,180,718 B1
(45) Date of Patent: Nov. 10, 2015

(54) DECOLORING APPARATUS

(71) Applicants: Kabushiki Kaisha Toshiba, Tokyo (JP); Toshiba Tec Kabushiki Kaisha, Tokyo (JP)

(72) Inventors: Naofumi Soga, Suntou Shizuoka (JP); Yuichi Saito, Numazu Shizuoka (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/754,502

(22) Filed: Jun. 29, 2015

(30) Foreign Application Priority Data

Jun. 30, 2014 (JP) ..... 2014-134959

(51) Int. Cl.
*B41J 15/10* (2006.01)
*B41M 7/00* (2006.01)

(52) U.S. Cl.
CPC ..... *B41M 7/009* (2013.01)

(58) Field of Classification Search
USPC ..... 347/171, 179, 152, 222; 399/167, 328
See application file for complete search history.

(56) References Cited

U.S. PATENT DOCUMENTS 7,324,237 B2 * 1/2008 Okada ..... B41J 11/0095 347/179
8,743,164 B2 6/2014 Iguchi et al.
8,899,855 B2 12/2014 Taki et al.
2010/0315475 A1 * 12/2010 Taki ..... B41J 2/32 347/179
2012/0038732 A1 * 2/2012 Iguchi ..... G03G 21/00 347/179

FOREIGN PATENT DOCUMENTS

JP 2010-141686 6/2010

OTHER PUBLICATIONS

U.S. Appl. No. 14/631,704, filed Feb. 25, 2015, inventor Takahiro Kawaguchi.

* cited by examiner

*Primary Examiner* — Kristal Feggins
(74) *Attorney, Agent, or Firm* — Patterson & Sheridan, LLP

(57) ABSTRACT

In one embodiment, a decoloring apparatus has a heating member for image decoloring, and a shutter to prevent heat transmission from the heating member. The decoloring apparatus further has a contact/separation mechanism for the heating member, a driving mechanism for the shutter, and a controller. The controller controls the contact/separation mechanism, to make the heating member to be moved to the non-decoloring position, and then controls the driving mechanism, to make the shutter to be moved to the shielding position.

17 Claims, 10 Drawing Sheets

DECOLORING APPARATUS

CROSS-REFERENCE TO RELATED APPLICATION

This application is based upon and claims the benefit of priority from the prior Japanese Patent Application No. 2014-134959, filed on Jun. 30, 2014, the entire contents of which are incorporated herein by reference.

FIELD

Embodiments described herein relate generally to an apparatus which can decolor an image formed of decolorable coloring agent.

BACKGROUND

Conventionally, a decoloring apparatus which can decolor an image formed of decolorable coloring agent is known. Since a sheet in which a color of an image has been decolored by the decoloring apparatus is reusable, the consumption of sheets can be suppressed. The decoloring apparatus is mainly used in an office and so on. In order to effectively use the space of an office, miniaturization of the decoloring apparatus has been tried.

A decoloring apparatus has a sheet feeding unit, an image reading unit, a decoloring unit and a sheet discharge tray for reuse. Further, the decoloring apparatus has a first sheet conveying path from the sheet feeding unit toward the sheet discharge tray via the image reading unit, and a second sheet conveying path which branches from the first sheet conveying path at a branch point located at the downstream of the image reading unit and goes toward the decoloring unit. A sheet to be fed by the sheet feeding unit is conveyed to the image reading unit via the first sheet conveying path. The image reading unit reads an image formed on the sheet. The decoloring apparatus determines whether or not an image has been formed on the sheet, based on the reading result by the image reading unit. When it is determined that an image has not been formed on the sheet, the sheet is conveyed to the sheet discharge tray via the first sheet conveying path. On the other hand, when it is determined that an image has been formed on the sheet, the sheet is conveyed to the decoloring unit via the second sheet conveying path.

However, in a miniaturized decoloring apparatus, there may be a case in which a length of the sheet is longer than a distance from the image reading unit to the branch point, depending on a sheet to be dealt with. When the length of the sheet is longer, a leading edge of the sheet in the sheet conveying direction reaches the branch point, before the reading of an image of the whole of the sheet to be conveyed is finished. As described above, when it is determined that an image has been formed on the sheet, it is necessary that the sheet which has reached the branch point is conveyed to the decoloring unit via the second sheet conveying path, so as to perform the decoloring processing.

However, when an image formed on a sheet contains a confidential content, for example, the confidential content is decolored by the decoloring unit. Here, the decoloring unit heats the decolorable coloring agent at not less than a prescribed temperature, to make the color of the coloring agent colorless and transparent. But even if the coloring agent has been colorless and transparent, the coloring agent remains on the sheet while being fixed to the sheet. In other words, an image containing the confidential content comes to be formed of the coloring agent which has become transparent, on the sheet after the decoloring by the decoloring unit. The image formed of the coloring agent which has become transparent can be viewed, depending on the reflective condition of light.

Even if the image containing the confidential content has been formed on the sheet discharged after the decoloring processing, as described above, there is a possibility that a user cannot recognize the confidential content. Accordingly, the sheet formed with the image containing the confidential content is handed over to a third party, and thereby the confidential information is likely to leak to the third party. Accordingly, regarding a sheet formed with an image containing a confidential content, it is more ideal not to perform the decoloring processing to such a sheet.

However, when a length of a sheet is longer than the distance from the image reading unit to the branch point, as described above, the sheet formed with an image containing a confidential content might be conveyed to the decoloring unit. Accordingly, when the decoloring processing is performed to the sheet formed with an image containing a confidential content, the confidential information is likely to leak to a third party.

DETAILED DESCRIPTION

Figure 1:
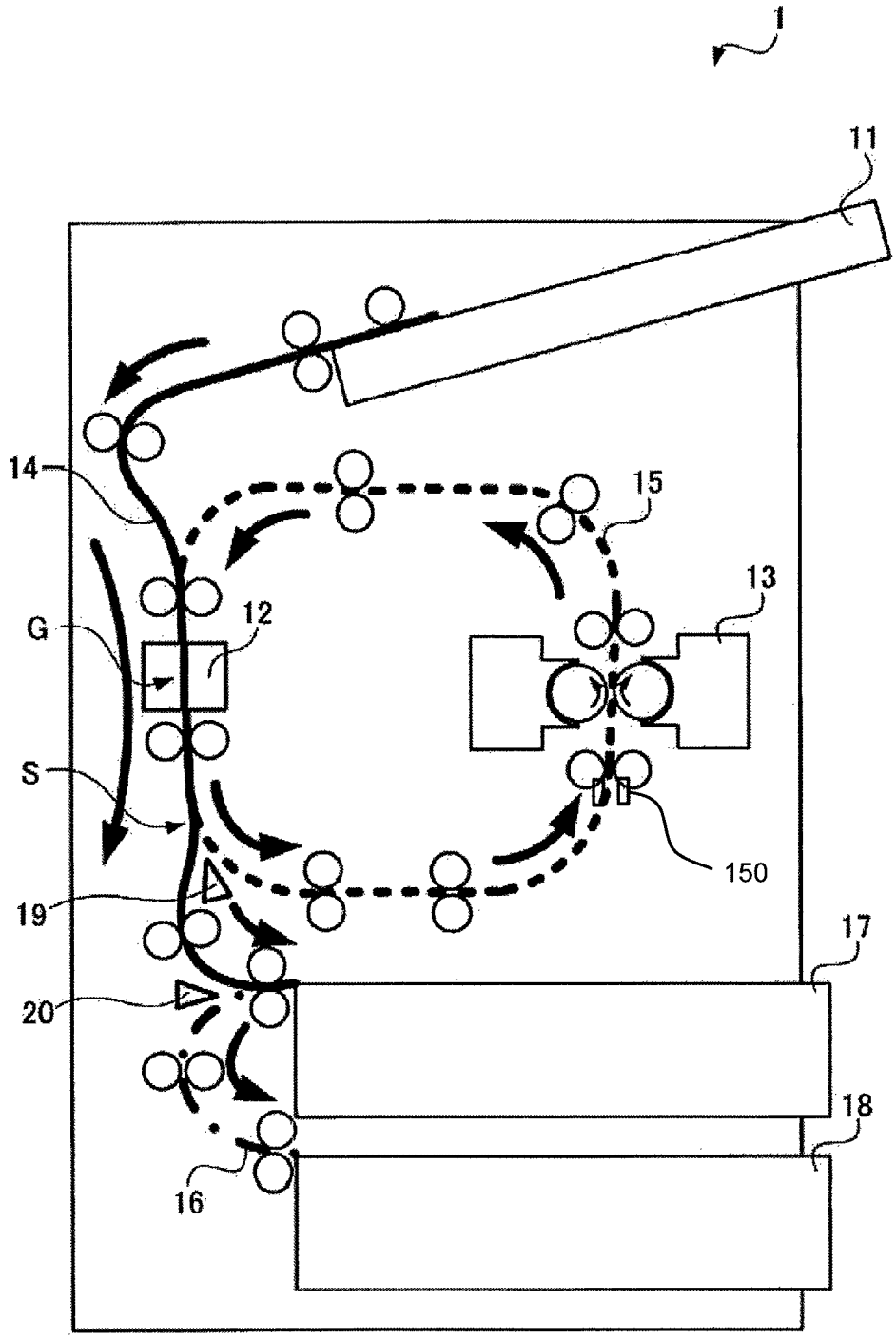
FIG. 1 is a sectional view showing a main portion of a decoloring apparatus according to a first embodiment.

According to one embodiment, a decoloring apparatus has a sheet conveying unit, a heating member, a contact/separation mechanism, a shutter, a driving mechanism and a controller. The sheet conveying unit conveys a sheet on which an image is formed. The heating member heats the image, so as to decolor the image formed on the sheet to be conveyed by the sheet conveying unit. The contact/separation mechanism moves the heating member between a decoloring position where the heating member heats the image and a non-decoloring position distant from the decoloring position. The shutter is interposed between the sheet to be conveyed by the sheet conveying unit and the heating member, to prevent that heat of the heating member is transmitted to the sheet. The driving mechanism moves the shutter between a shielding position where the shutter prevents the heat transmission and an open position distant from the shielding position. The controller controls the contact/separation mechanism, to make the heating member to be moved to the non-decoloring position, and then controls the driving mechanism, to make the shutter to be moved to the shielding position.

Hereinafter, further embodiments will be described with reference to the drawings. In the drawings, the same symbols indicate the same or similar portions.

A whole configuration of a decoloring apparatus according to a first embodiment will be described with reference to FIG. 1. FIG. 1 is a sectional view showing a main portion of the decoloring apparatus according to the first embodiment.

As shown in FIG. 1, a decoloring apparatus 1 has a sheet feeding unit 11, an image read sensor 12, a decoloring unit 13, a shutter unit 150, a first sheet conveying unit 14, a second sheet conveying unit 15, a third sheet conveying unit 16, a first sheet discharge tray 17, a second sheet discharge tray 18, a first separator 19, and a second separator 20.

The sheet feeding unit 11 has a sheet feeding tray which supports sheets in a stacked state. An image is formed on a sheet to be supported to the sheet feeding tray, using coloring agent which is decolorable by heat. The sheet feeding unit 11 takes out sheets one by one from the sheet feeding tray, and feeds the taken out sheet to the first sheet conveying unit 14. The first sheet conveying unit 14 has a first conveying path which passes through the image read sensor 12 and goes toward the first sheet discharge tray 17. The first sheet conveying unit 14 uses the first conveying path, to convey the above-described fed sheet to the first sheet discharge tray 17 via the image read sensor 12.

The image read sensor 12 reads the image formed on the sheet to be conveyed by the first sheet conveying unit 14 at an image reading position G. Data of the image read by the image read sensor 12 is stored in a storage unit 22 (refer to FIG. 4) described later. A controller 21 (refer to FIG. 4) described later determines whether the image formed on the sheet is an image (a decoloring processable image) to which the decoloring processing may be performed, or a decoloring non-processable image, based on the data of the image stored in the storage unit 22. Specifically, the controller 21 determines whether the image formed on the sheet is an image (a decoloring non-processable image) which contains a confidential content, or is an image (a decoloring processable image) which does not contain a confidential content, for example. Hereinafter, an image which contains a confidential content or a sheet formed with the relevant image is called a confidential document. In other words, the controller 21 (refer to FIG. 4) determines whether or not an image formed on a sheet is a confidential document, based on the data of the image stored in the storage unit 22. The detail of the processing to determine a confidential document will be described later.

The first separator 19 is arranged at a position (hereinafter, called a branch position S) which is more downstream than the image read sensor 12 and more upstream than the first sheet discharge tray 17, in the above-described first conveying path. The first separator 19 leads the sheet to be conveyed by the first sheet conveying unit 14 to a direction of the first and second sheet discharge trays 17, 18, or to the second sheet conveying unit 15. The second sheet conveying unit 15 has a second conveying path which branches from the first conveying path at the branch position S of the first separator 19, passes through the decoloring unit 13, and merges with the first conveying path at a more upstream position than the image read sensor 12. The second sheet conveying unit 15 uses the second conveying path, to convey the sheet to be led by the first separator 19 to the decoloring unit 13. The second sheet conveying unit 15 has a pair of conveying guides 151A, 151B to guide a sheet which passes through the decoloring unit 13 (refer to FIG. 2 and FIG. 3, for example). The sheet to be conveyed to the decoloring unit 13 is conveyed within the conveying guides 151A, 151B. The conveying guides 151A, 151B have openings 156A, 156B to expose the sheet to be conveyed within the conveying guides 151A, 151B, respectively. The openings 156A, 156B are formed in the conveying guide 151A, 151B so as to be located in the moving routes of heating members 131A, 131B described later, respectively. The heating members 131A, 131B are reciprocated between decoloring positions described later within the openings 156A, 156B, and non-decoloring positions described later outside the openings 156A, 156B, respectively. The openings 156A, 156B are opened and closed by shutters 152A, 152B described later, respectively. Further, the second sheet conveying unit 15 uses the second conveying path, to return the sheet which has been subjected to the decoloring processing by the decoloring unit 13 to the first conveying path of the first sheet conveying unit 15 again.

When it is determined that the image of the sheet to be conveyed is not a confidential document, the decoloring unit 13 heats the sheet, to decolor the image formed on the sheet. On the other hand, when it is determined that the image of the sheet to be conveyed is a confidential document, the decoloring unit 13 does not perform the decoloring processing to the relevant sheet as described later. The detail of the decoloring unit 13 will be described later.

The sheet which has passed through the decoloring unit 13 is returned to the first conveying path of the first sheet conveying unit 14 by the second sheet conveying unit 15, and is further conveyed by the first conveying unit 14, to pass through the image read sensor 12. The image read sensor 12 reads again the image formed on the sheet. The controller 21 described later determines whether or not the image formed on the sheet has been decolored to such an extent that the sheet is reusable, based on the data of the read image. When it is determined that the sheet which has been subjected to the decoloring processing is reusable, the first sheet conveying unit 14 uses the first conveying path, to discharge the sheet to the first sheet discharge tray 17. On the other hand, when it is determined that the sheet which has been subjected to the decoloring processing is not reusable, the sheet is discharged to the second sheet discharge tray 18 by the second separator 20 and the third sheet conveying unit 16.

The second separator 20 is arranged in the first conveying path at a position that is more downstream than the above-described arrangement position of the first separator 19, and more upstream than the first sheet discharge tray 17. The second separator 20 leads the sheet to be conveyed by the first sheet conveying unit 14 to the first sheet discharge tray 17 or the third sheet conveying unit 16. The third sheet conveying unit 16 has a third conveying path which branches from the first conveying path at the above-described arrangement position of the second separator 20 and goes toward the second sheet discharge tray 18. The third sheet conveying unit 16 uses the third conveying path, to discharge the sheet to be led by the second separator 20 to the second sheet discharge tray 18. The first and second sheet discharge trays 17, 18 are detachably provided at the lower portions in the main body of the decoloring apparatus 1, for example. The first sheet discharge tray 17 houses the sheet to be discharged by the first sheet conveying unit 14. In other words, the first sheet discharge tray 17 houses the sheet which has been determined to be reusable as described above. The second sheet discharge tray 18 houses the sheet discharged by the third sheet conveying unit 16. In other words, the second sheet discharge tray 18 houses the sheet which has been determined to be non-reusable as described above. The sheet which has been determined to be non-reusable as described above also contains the above-described confidential document.

Figure 2:
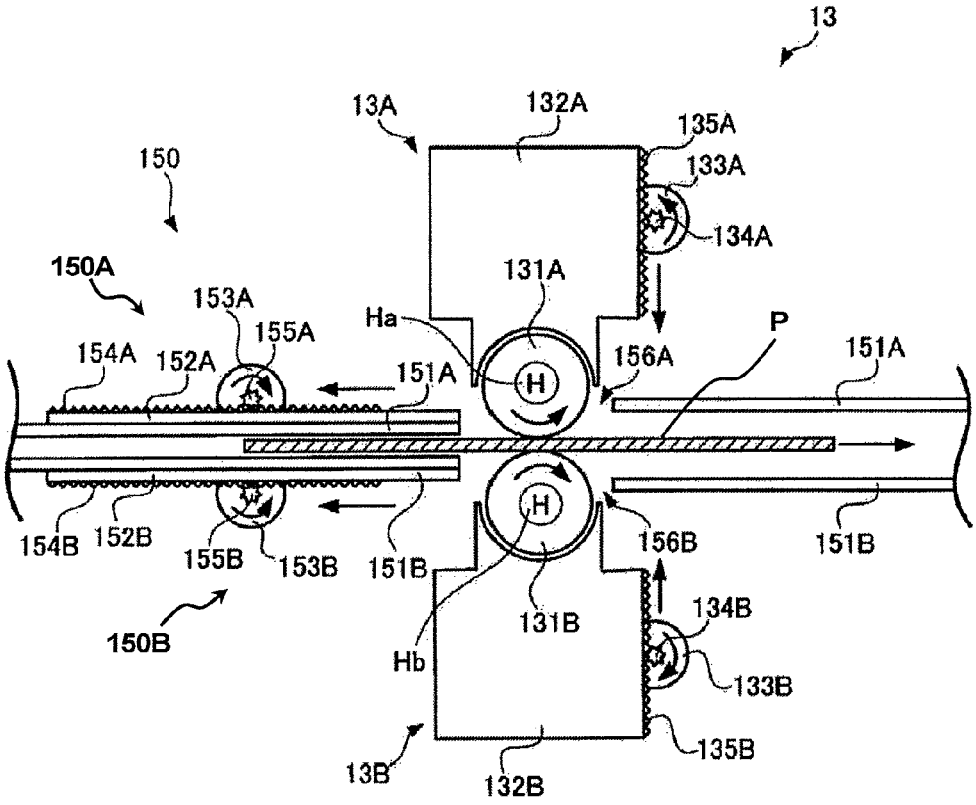
FIG. 2 is a diagram showing the decoloring unit and the shutter unit, when the decoloring apparatus according to the first embodiment executes a decoloring processing.
Figure 3:
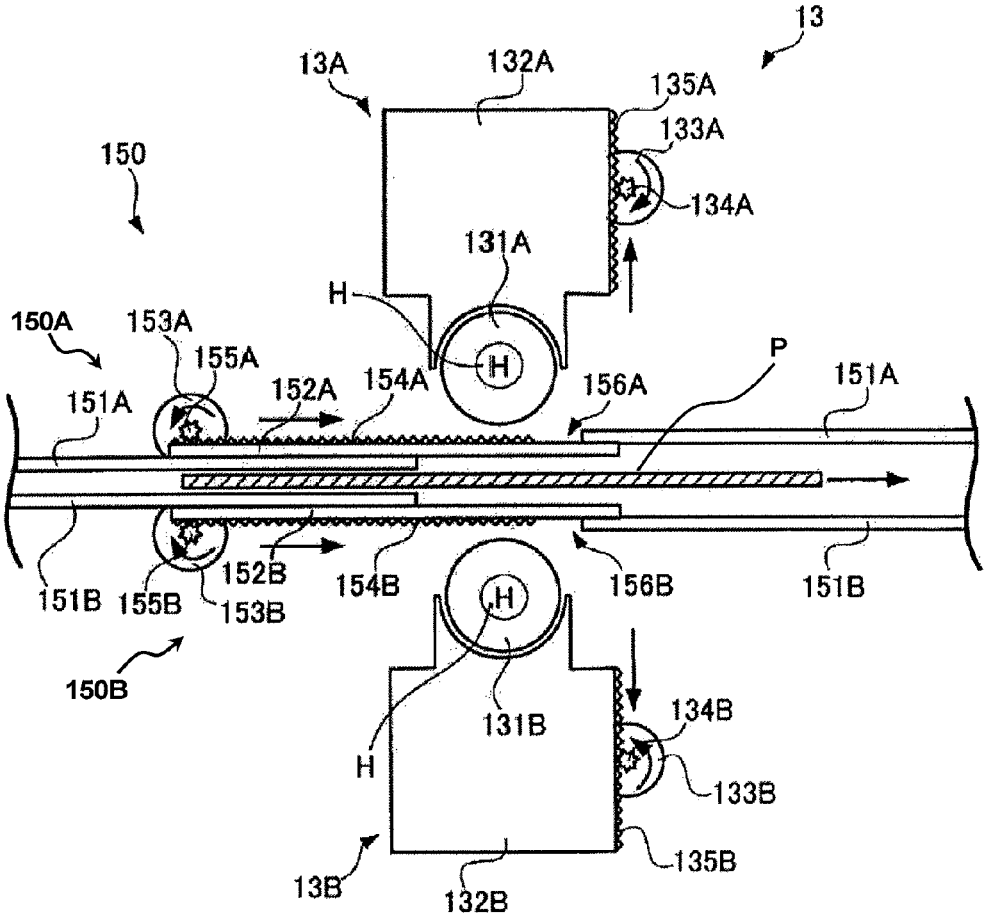
FIG. 3 is a diagram showing the decoloring unit and the shutter unit, when the decoloring apparatus according to the first embodiment prohibits the decoloring processing.

The first to third sheet conveying units 14-16 further have a plurality of conveying rollers for conveying a sheet. The plurality of conveying rollers are arranged along the first to third conveying paths of the first to third sheet conveying units 14-16. The plurality of conveying rollers convey a sheet in the first to third conveying paths. Hereinafter, the decoloring unit 13, and the shutter unit 150 to prevent the heat transmission from the decoloring unit 13 will be described with reference to FIG. 2 and FIG. 3. FIG. 2 is a diagram showing the decoloring unit 13 and the shutter unit 150, when the decoloring apparatus 1 executes the decoloring processing by the decoloring unit 13. When the decoloring apparatus 1 executes the decoloring by the decoloring unit 13, while the shutters 152A, 152B open the openings 156A, 156B, as described later, the heating members 131A, 131B are located at decoloring positions described later, respectively. FIG. 3 is a diagram showing the decoloring unit 13 and the shutter unit 150, when the decoloring apparatus 1 prohibits the decoloring processing by the decoloring unit 13. When the decoloring apparatus 1 prohibits the decoloring processing by the decoloring unit 13, while the shutters 152A, 152B shield the openings 156A, 156B as described later, the heating members 131A, 131B are located at non-decoloring positions described later, respectively.

As shown in FIG. 2 and FIG. 3, the decoloring unit 13 has a first decoloring unit 13A and a second decoloring unit 13B. The first and second decoloring units 13A, 13B are arranged opposite to each other while sandwiching the conveying guides 151A, 151B of the second conveying unit 15 therebetween. The first and second decoloring units 13A, 13B have the same configuration. Specifically, the first and second decoloring units 13A, 13B have the heating members 131A, 131B, and contact/separation mechanisms 133A, 133B, respectively. The contact/separation mechanisms 133A, 133B respectively include supports 132A, 132B and so on, as described later.

In order to decolor an image formed on a sheet P to be conveyed within the conveying guides 151A, 151B of the second sheet conveying unit 15, the heating members 131A, 131B heat the above-described image. The heating members 131A, 131B include heating rollers which are rotatably supported to the supports 132A, 132B of the contact/separation mechanisms 133A, 133B, respectively. The heating rollers of the heating members 131A, 131B rotate by driving forces of drive motors not shown, respectively. The heating rollers of the heating members 131A, 131B rotate while being in contact with the sheet P at the decoloring positions described below, to heat the sheet P while conveying the sheet P. Specifically, as shown in FIG. 2, when the decoloring processings by the first and second decoloring units 13A, 13B are executed, the heating rollers of the heating members 131A, 131B enter within the conveying guides 151A, 151B of the second conveying unit 15, via the openings 156A, 156B of the conveying guides 151A, 151B, respectively. The heating rollers of the heating members 131A, 131B which have entered within the conveying guides 151A, 151B rotate while being in contact with the sheet P at decoloring positions described later, respectively. The heating rollers of the heating members 131A, 131B have heat sources Ha, Hb inside, respectively. The heat sources Ha, Hb generate heats in the heating rollers of the heating members 131A, 131B, to transmit the heats to the faces of the heating rollers in contact with the above-described sheet P, respectively. The heating rollers of the heating members 131A, 131B heat the image formed on the sheet P by the heats of the heat sources Ha, Hb at a prescribed decoloring temperature, respectively.

Hereinafter, the moving operation of the heating members 131A, 131B will be described in detail. The contact/separation mechanisms 133A, 133B linearly reciprocate the heating members 131A, 131B between decoloring positions described later and non-decoloring positions distant from the decoloring positions, respectively. The contact/separation mechanisms 133A, 133B have the supports 132A, 132B, racks 135A, 135B, and pinions 134A, 134B, respectively. The supports 132A, 132B rotatably support the heating members 131A, 131B, respectively, as described above. The racks 135A, 135B are respectively fitted on side surfaces of the supports 132A, 132B, along a direction orthogonal to the sheet conveying direction by the conveying guides 151A, 151B. The pinions 134A, 134B are fitted to drive units of the contact/separation mechanisms 133A, 133B, respectively. The pinions 134A, 134B engage with the racks 135A, 135B of the supports 132A, 132B, respectively. The contact/separation mechanisms 133A, 133B rotate the pinions 134A, 134B forward and reversely, so as to reciprocate the heating members 131A, 131B between the decoloring positions described later and the non-decoloring positions described later, respectively. When the contact/separation mechanisms 133A, 133B rotate the pinions 134A, 134B, the driving forces of the contact/separation mechanisms 133A, 133B are transmitted to the racks 135A, 135B, as the rotating forces of the pinions 134A, 134B, respectively. The above-described driving forces are transmitted to the racks 135A, 135B, and thereby the supports 132A, 132B linearly reciprocate along the direction orthogonal to the sheet conveying direction, respectively. The supports 132A, 132B reciprocate, to cause the heating members 131A, 131B which are supported to the supports 132A, 132B to move between the decoloring positions and the non-decoloring positions, respectively. Specifically, as shown in FIG. 2, the contact/separation mechanism 133A rotates the pinion 134A in the counterclockwise direction, by a prescribed number of rotations. On the other hand, the contact/separation mechanism 133B rotates the pinion 134B in the clockwise direction, by a prescribed number of rotations. With the rotations of the pinions 134A, 134B, the supports 132A, 132B make the heating members 131A, 131B enter from the openings 156A, 156B within the conveying guides 151A, 151B, till the heating members 131A, 131B reach the decoloring positions, respectively. Further, as shown in FIG. 3, the contact/separation mechanism 133A rotates the pinion 134A in the clockwise direction, by a prescribed number of rotations. On the other hand, the contact/separation mechanism 133B rotates the pinion 134B in the counterclockwise direction, by a prescribed number of rotations. With the rotations of the pinions 134A, 134B, the supports 132A, 132B make the heating members 131A, 131B retract from the openings 156A, 156B to the outside of the conveying guides 151A, 151B, till the heating members 131A, 131B reach the non-decoloring positions, respectively. In other words, the supports 132A, 132B are reciprocated by the contact/separation mechanisms 133A, 133B, and thereby the heating members 131A, 131B move between the decoloring positions and the non-decoloring positions, respectively. The decoloring positions are positions (positions shown in FIG. 2) of the heating members 131A, 131B when the heating members 131A, 131B come in contact with the sheet P to be conveyed within the conveying guides 151A, 151B of the second sheet conveying unit 15, and heat the image formed on the sheet P, to perform the decoloring processing, respectively. The non-decoloring positions are positions (positions shown in FIG. 3) of the heating members 131A, 131B when the heating members 131A, 131B separate from the sheet P to be conveyed within the conveying guides 151A, 151B of the second sheet conveying unit 15, and do not perform the decoloring processing, respectively. Accordingly, the heating members 131A, 131B linearly move, along with the movements of the supports 132A, 132B, between the decoloring positions and the non-decoloring positions, along the direction orthogonal to the sheet conveying direction, respectively.

As shown in FIG. 2 and FIG. 3, the shutter unit 150 has a first shutter unit 150A and a second shutter unit 150B. The first and second shutter units 150A, 150B are arranged opposite to each other while sandwiching the conveying guides 151A, 151B of the second sheet conveying unit 15 therebetween. The first and second shutter units 150A, 150B have the same configuration. Specifically the first and second shutter units 150A, 150B have the shutters 152A, 152B and driving mechanisms 153A, 153B, respectively. The shutters 152A, 152B interpose between the sheet P to be conveyed by the above-described second sheet conveying unit 15 and the above-described heating members 131A, 131B, to prevent the heats of the above-described heating members 131A, 131B from being transmitted to the above-described sheet P, respectively. Specifically, the shutters 152A, 152B are slidably supported to the conveying guides 151A, 151B, along the second conveying path of the second sheet conveying unit 15, respectively. The shutters 152A, 152B slide as described above, to reciprocate between open positions and shielding positions separate from the open positions, respectively. The open positions are positions of the shutters 152A, 152B, when the shutters 152A, 152B open the openings 156A, 156B of the conveying guides 151A, 151B, to allow the heating members 131A, 131B to move to the above-described decoloring positions, respectively. When allowing the heating members 131A, 131B to move to the above-described decoloring positions, the shutters 152A, 152B move to the open positions, respectively. The shielding positions are positions of the shutters 152A, 152B, when the shutters 152A, 152B shield the openings 156A, 156B of the conveying guides 151A, 151B, to prevent that the heats from the heating members 131A, 131B are transmitted. When preventing that the heats from the heating members 131A, 131B are transmitted, the shutters 152A, 152B move to the shielding positions, respectively. The shutters 152A, 152B include plate-like members made of material having heat insulating effect, in order to prevent that the heats from the heating members 131A, 131B are transmitted, respectively. As the material having heat insulating effect, rigid urethane foam is used, for example. The conveying guides 151A, 151B slidably support the shutters 152A, 152B, respectively, as described above. Specifically, as shown in FIG. 2 and FIG. 3, the conveying guides 151A, 151B have guide surfaces at the upstream side in the sheet conveying direction, and guide surfaces at the downstream side in the sheet conveying direction, with the openings 156A, 156B as the boundary, respectively. The conveying guides 151A, 151B support the shutters 152A, 152B located at the open positions, using the above-described upstream side guide surfaces, respectively (refer to FIG. 2). The conveying guides 151A, 151B support the shutters 152A, 152B located at the shielding positions, using the above-described upstream side guide surfaces and downstream side guide surfaces, respectively (refer to FIG. 3).

The driving mechanisms 153A, 153B move the shutters 152A, 152B between the above-described shielding positions and the above-described open positions, respectively. The driving mechanisms 153A, 153B have racks 154A, 154B and pinions 155A, 155B, respectively. As shown in FIG. 2 and FIG. 3, the racks 154A, 154B are fitted to side surfaces of the shutters 152A, 152B which are not opposite to the conveying guides 151A, 151B, along the sheet conveying direction, respectively. The pinions 155A, 155B are fitted to the driving units of the driving mechanisms 153A, 153B, respectively. The pinions 155A, 155B engage with the racks 154A, 154B of the shutters 152A, 152B, respectively. The driving mechanisms 153A, 153B rotate forward and reversely the pinions 155A, 155B, so as to reciprocate the shutters 152A, 152*b* between the shielding positions and the open positions, respectively. When the driving mechanisms 153A, 153B rotate the pinions 155A, 155B, the driving forces of the driving mechanisms 153A, 153B are transmitted to the racks 154A, 154B, as the rotating forces of the pinions 155A, 155B, respectively. The above-described driving forces are transmitted to the racks 154A, 154B, and thereby the shutters 152A, 152B reciprocate along the sheet conveying direction, respectively. Specifically, as shown in FIG. 2, the driving mechanism 153A rotates the pinion 155A in the clockwise direction by a prescribed number of rotations. On the other hand, the driving mechanism 153B rotates the pinion 155B in the counterclockwise direction by a prescribed number of rotations. With the rotations of the pinions 155A, 155B, the shutters 152A, 152B move to the open positions, respectively. Further, as shown in FIG. 3, the driving mechanism 153A rotates the pinion 155A in the counterclockwise direction by a prescribed number of rotations. On the other hand, the driving mechanism 153B rotates the pinion 155B in the clockwise direction by a prescribed number of rotations. With the rotations of the pinions 155A, 155B, the shutters 152A, 152B move from the open positions to the shielding positions, respectively. The shutters 152A, 152B reciprocate between the open positions and the shielding positions, as described above, to open and close the openings 156A, 156B, respectively.

An operation in which the shutters 152A, 152B open the openings 156A, 156B, and thereby the decoloring processings by the heating members 131A, 131B are executed, respectively, will be described with reference to FIG. 2.

When the decoloring processing by the first decoloring unit 13A is executed, the shutter 152A opens the opening 156A. Specifically, as described above, the operation of the shutter 152A to open the opening 156A is performed by rotating the pinion 155A by the driving mechanism 153A. The driving mechanism 153A rotates the pinion 155A, and thereby the shutter 152A moves to the above-described open position. The shutter 152A is located at the open position, to open the opening 156A of the conveying guide 151A. The opening 156A has such a size that the heating member 131A can move to the above-described decoloring position via the opening 156A. In other words, when the shutter 152A is located at the open position, the heating member 131A can move to the decoloring position.

After the shutter 152A has moved to the above-described open position, the heating member 131A moves to the above-described decoloring position. Specifically, as described above, the contact/separation mechanism 133A rotates the pinion 134A, and thereby the heating member 131A moves to the decoloring position via the opening 156A. The shutter 152A is located at the open position, and thereby the decoloring processing by the heating member 131A is allowed. The heating member 131A heats, while pressurizing, an image of the sheet P which has been conveyed within the conveying guides 151A, 151B at a prescribed decoloring temperature, at the decoloring position. The heating members 131A, 131B heat the image while pressurizing, to decolor the image.

In the operation in which the above-described decoloring processing is executed, the second decoloring unit 13B operates in the same manner as the first decoloring unit 13A. The contact/separation mechanism 133B of the second decoloring unit 13B rotates the pinion 134B, and thereby the heating member 131B moves to the above-described decoloring position. Further, the second shutter unit 150B operates in the same manner as the first shutter unit 150A. The driving mechanism 153B of the second shutter unit 150B rotates the pinion 155B, and thereby the shutter 152B moves to the above-described open position.

An operation in which the shutter 152A shields the opening 156A, and thereby the decoloring processing by the heating members 131A is prohibited, will be described with reference to FIG. 3. When the decoloring apparatus 1 prohibits the decoloring processing by the first decoloring unit 13A, the shutter 152A shields the opening 156A. Specifically, as described above, the contact/separation mechanism 133A rotates the pinion 134A, and thereby the heating member 131A passes through the opening 156A from the above-described decoloring position, and moves to the above-described non-decoloring position. After the heating member 131A has moved to the non-decoloring position, the shutter 152A moves to the above-described shielding position. Specifically, as described above, the driving mechanism 153A rotates the pinion 155A, and thereby the shutter 152A moves from the above-described open position to the shielding position. The shutter 152A is located at the shielding position, to shield the opening 156A of the conveying guide 151A. In other words, the shutter 152A separates the heating member 131A from the sheet P to be conveyed within the conveying guides 151A, 151B. The shutter 152A separates the heating member 131A from the sheet P, to prevent that the heat from the heating member 131A is transmitted to the sheet P. The shutter 152A prevents the transmission of the heat from the heating member 131A, to prohibit the decoloring processing by the heating member 131A. Also in the operation in which the above-described decoloring processing is prohibited, the second decoloring unit 13B operates in the same manner as the first decoloring unit 13A. The contact/separation mechanism 133B of the second decoloring unit 13B rotates the pinion 134B, and thereby the heating member 131B moves to the non-decoloring position. Further, the second shutter unit 150B operates in the same manner as the first shutter unit 150A. The driving mechanism 153B of the second shutter unit 150B rotates the pinion 155B, and thereby the shutter 152B moves to the shielding position.

When the shutters 152A, 152B prevent the heat transmission to the sheet P, it is not necessary for the shutters 152A, 152B to completely shield the openings 156A, 156B, respectively. The shutters 152A, 152B may block at least one portions of the openings 156A, 156B, to prevent the heat transmission from the heating members 131A, 131B to the sheet P, respectively.

Further, it is preferable that the conveying guides 151A, 151B are formed of material having heat insulting effect, in the same manner as the shutters 152A, 152B. This is because there is a possibility that even when the shutters 151A, 151B shield the openings 156A, 156B, if the heat insulting effect of the conveying guides 151A, 151B is low, the heats of the heating members 131A, 131B might be transmitted to the sheet P via the conveying guides 151A, 151B.

Figure 4:
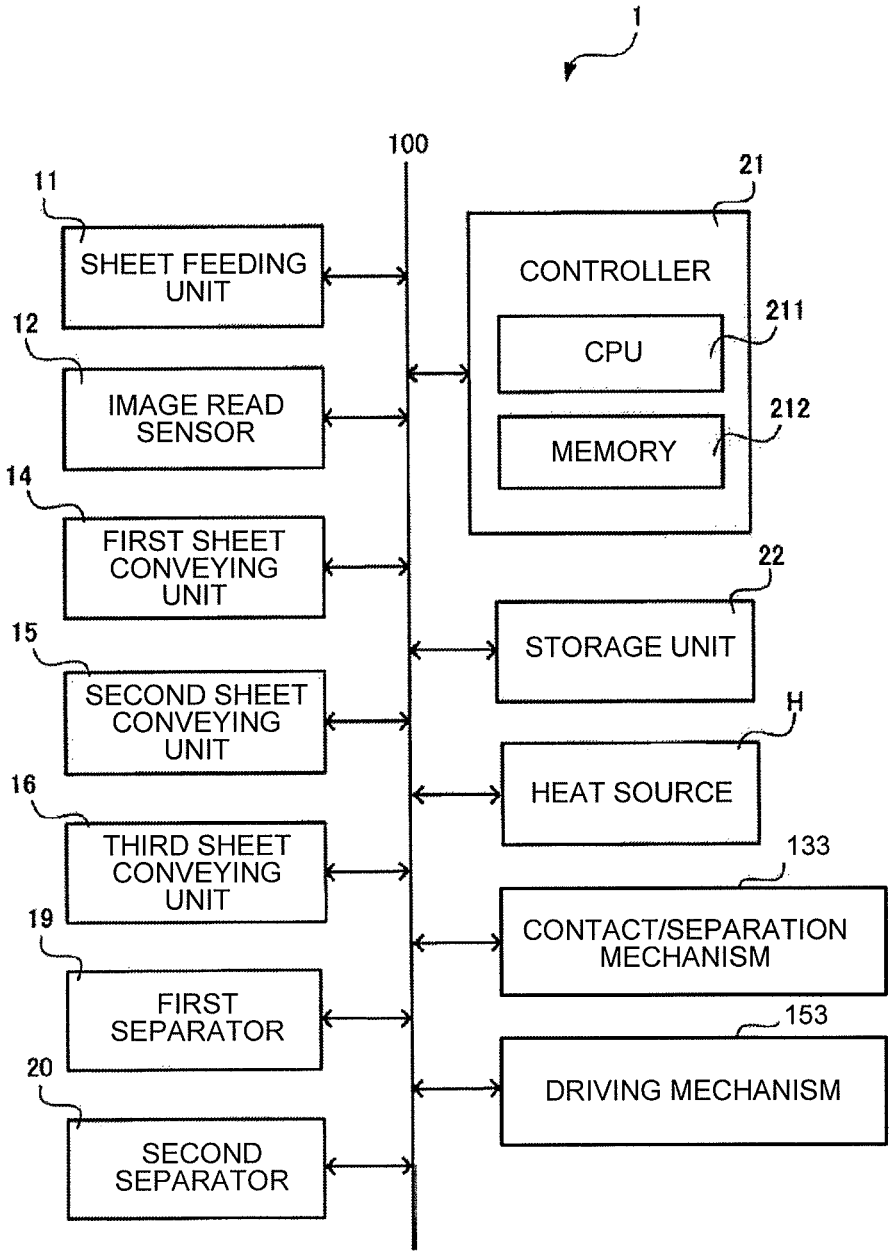
FIG. 4 is a block diagram showing a hardware configuration of the decoloring apparatus according to the first embodiment.

Hereinafter, a hardware configuration of the decoloring apparatus according to the first embodiment will be described with reference to FIG. 4. FIG. 4 is a block diagram showing a hardware configuration of the decoloring apparatus 1.

As shown in FIG. 4, a heat source H, the sheet feeding unit 11, the image read sensor 12, the first to third sheet conveying units 14-16, the first and second separators 19, 20, the controller 21, the storage unit 22, a contact/separation mechanism 133, and a driving mechanism 153 connect to each other via a communication bus 100. The heat source H includes the heat source Ha of the first decoloring unit 13A and the heat source Hb of the second decoloring unit 13B. The contact/separation mechanism 133 includes the contact/separation mechanism 133A of the first decoloring unit 13A and the contact/separation mechanism 133B of the second decoloring unit 13B. The driving mechanism 153 includes the driving mechanism 153A of the first shutter unit 150A and the driving mechanism 153B of the second shutter unit 150B.

The controller 21 includes a CPU 211 and a memory 212. The CPU 211 controls a processing operation of the decoloring apparatus 1 in accordance with a computer program. The memory 212 stores the computer program. The computer program includes a plurality of instructions so as to control the processing operation of the decoloring apparatus 1. In other words, the CPU 211 reads the computer program stored in the memory 212, so as to control the processing operation of the decoloring apparatus 1, and executes a plurality of the instructions included in the computer program. The memory 212 includes a ROM (Read Only Memory), a RAM (Random Access Memory), an EEPROM (Electrically Erasable Programmable Read-Only Memory) and so on. The memory 212 stores, in addition to the above-described computer program, various data generated when the CPU 211 executes the instructions of the computer program. The storage unit 22 stores data and so on of an image read by the image read sensor 12.

Figure 5:
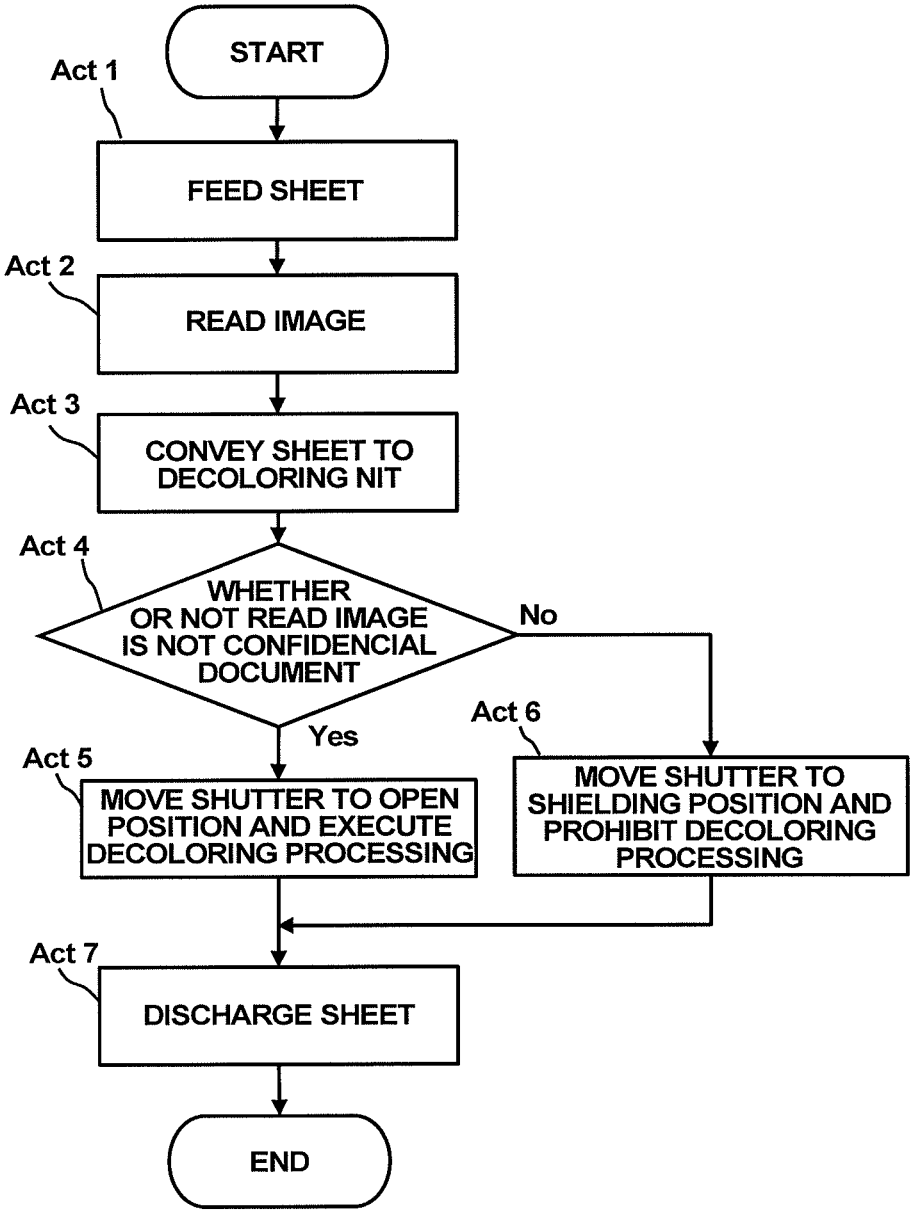
FIG. 5 is a flow chart showing a decoloring processing including an opening and closing operation of the shutter, in the decoloring apparatus according to the first embodiment.

FIG. 5 is a flow chart showing a control operation of a decoloring processing of the decoloring apparatus 1. Hereinafter, a control operation of a decoloring processing will be described with reference to FIG. 5. Specifically, for example, a control operation of a decoloring processing when a length of a sheet to be fed from the sheet feeding tray of the sheet feeding unit 11 is longer than a distance from the image reading position G to the branch position S, will be described. The length of a sheet is a length of the sheet in the sheet conveying direction. The controller 21 judges the length of the sheet, based on the information of the sheet to be inputted by a user from an operation panel not shown, for example. Further, the controller 21 judges a length of the sheet, based on the detection result of a sensor not shown provided at the sheet feeding unit 11, for example. The image reading position G is a position where an image formed on the sheet is read by the image read sensor 12, as described above (refer to FIG. 1). The branch position S is a position where the second conveying path of the second sheet conveying unit 15 branches from the first conveying path of the first sheet conveying unit 14 (refer to FIG. 1). When the length of the sheet is longer than the distance from the image reading position G to the branch position S, a leading end of the sheet, that is, an end at the downstream side in the sheet conveying direction reaches the branch point, before the image reading operation of the whole sheet by the image read sensor 12 ends. Accordingly, in order that the image read sensor 12 can read an image formed on the whole sheet, it is necessary that the sheet is conveyed to the more downstream side in the sheet conveying direction than the branch position S in the first conveying path, or to the second conveying path. On the other hand, when an image is formed on the sheet, in order to perform the decoloring processing, it is necessary that the sheet which has reached the branch position S is conveyed to the second conveying path heading for the decoloring unit 13. Accordingly, when the length of the sheet is longer than the distance from the image reading position G to the branch position S, the sheet is led to the second conveying path of the second sheet conveying unit 15, and passes through the decoloring unit 13.

Specifically, in an Act1 shown in FIG. 5, the controller 21 controls the sheet feeding unit 11 so as to feed a sheet. The sheet feeding unit 11 feeds a sheet loaded on the sheet feeding tray to the first conveying path of the first sheet conveying unit 14. Further, the controller 21 controls the first sheet conveying unit 14, so as to convey the sheet to the image read sensor 12. The first sheet conveying unit 14 conveys the sheet to be fed from the sheet feeding tray of the sheet feeding unit 11 to the image read sensor 12. After the above-described sheet has been fed, the operation of the decoloring apparatus 1 proceeds to an Act2.

In the Act2, the controller 21 controls the image read sensor 12, so as to read an image of the sheet. The image read sensor 12 reads an image formed on the sheet to be conveyed by the first sheet conveying unit 14. The controller 21 stores data of the above-described read image, using the storage unit 22 (refer to FIG. 4). After the above-described image has been read, the operation of the decoloring apparatus 1 proceeds to an Act3.

In the Act3, the controller 21 controls the first sheet conveying unit 14, the first separator 19 and the second sheet conveying unit 15, so as to convey the sheet to the decoloring unit 13. The first sheet conveying unit 14 conveys the sheet from which the above-described image has been read toward the branch position S. The first separator 19 leads the sheet which has reached the branch position S to the second conveying path of the second sheet conveying unit 15. The second sheet conveying unit 15 conveys the sheet led by the first separator 19 toward the decoloring unit 13. After the above-described sheet has been conveyed, the operation of the decoloring apparatus 1 proceeds to an Act4.

In the Act4, the controller 21 determines whether or not the image read by the image read sensor 12 is not a confidential document. When the controller 21 has determined that the above-described read image is not a confidential document, the operation of the decoloring apparatus 1 proceeds to an Act 5 (Yes, in the Act4). On the other hand, when the controller 21 has determined that the above-described read image is a confidential document, the operation of the decoloring apparatus 1 proceeds to an Act 6 (No, in the Act 4).

The controller 21 executes the instruction of the program stored in the memory 212, to determine whether or not the image is a confidential document. Specifically, the controller 21 reads the data of the image stored in the storage unit 22. The controller 21 judges whether or not characters such as "FOR INTERNAL USE ONLY" are included in the data of the read image. The controller 21 judges that the characters of "FOR INTERNAL USE ONLY" are included in the data of the image, to determine that the image formed on the sheet is a confidential document. In addition, a method of determining whether or not an image formed on a sheet is a confidential document is not limited to the above-described method.

In the Act 5, the controller 21 controls the heat source H of the decoloring unit 13, so as to convey the sheet while executing the decoloring processing. Further, the controller controls the contact/separation mechanism 133 of the decoloring unit 13 and the driving mechanism 153 of the shutter unit 150, so as to execute the decoloring processing. Specifically, the driving mechanism 153 moves the shutters 152A, 152B to the above-described open positions. After the shutters 152A, 152B have been moved to the open positions, the contact/separation mechanism 133 moves the heating members 131A, 131B of the decoloring unit 13 to the above-described decoloring positions. The heating members 131A, 131B heat, while pressurizing, an image of the sheet to be conveyed within the conveying guides 151A, 151B of the second sheet conveying unit 15 at the decoloring positions, to decolor the image of the sheet. As described above, the heat sources H of the heating members 131A, 131B include the heat sources Ha, Hb, respectively. The controller 21 controls the heat sources Ha, Hb, so that the heating temperatures at which the heating members 131A, 131B heat the image of the sheet become prescribed decoloring temperatures, respectively. The detail of the above-described operation by the decoloring unit 13 and the shutter unit 150 is as described above.

In the Act6, the controller 21 controls the contact/separation mechanism 133 and the driving mechanism 153, so as to convey the sheet while prohibiting the decoloring processing by the decoloring unit 13. The contact/separation mechanism 133 moves the heating members 131A, 131B of the decoloring unit 13 to the above-described non-decoloring positions. After the heating members 131A, 131B have been moved to the non-decoloring positions, the driving mechanism 153 moves the shutters 152A, 152B of the shutter unit 150 to the above-described shielding positions. The detail of the above-described operation by the decoloring unit 13 and the shutter unit 150 is as described above. After the sheet has been conveyed while being subjected to the decoloring processing in the above-described Act5, or after the sheet has been conveyed while the decoloring processing is prohibited in the above-described Act6, the operation of the decoloring apparatus 1 proceeds to an Act7.

In the Act7, the controller 21 controls the first to third sheet conveying units 14-16, the first and second separators 19, 20, and the image read sensor 12, so as to discharge the sheet after having passed through the decoloring unit 13. The second sheet conveying unit 15 returns the sheet after having passed through the decoloring unit 13 to the first conveying path of the first sheet conveying unit 14. The first sheet conveying unit 14 conveys the sheet to the image read sensor 12 again. For example, the image read sensor 12 reads the image of the sheet after the decoloring processing by the above-described Act5. The controller 21 judges whether or not the sheet is reusable, based on the data of the read image of the sheet. The image read sensor 12 does not perform the image reading operation to the sheet to be conveyed without being subjected to the decoloring processing in the above-described Act6. The controller 21 judges that the sheet to be conveyed without being subjected to the decoloring processing is not reusable, based on the determination result in the above-described Act 4 that the image of the sheet is a confidential document. The first separator 19 leads the sheet to the direction of the first and second sheet discharge trays 17, 18 at the branch position S. When the controller 21 has judged that the sheet is reusable, the second separator 20 leads the sheet led by the first separator 19 to the first sheet discharge tray 17, to discharge the sheet. Further, when the controller 21 has judged that the sheet is not reusable, the second separator 20 leads the sheet led by the first separator 19 to the third conveying path of the third sheet conveying unit 16. The third sheet conveying unit 16 leads the sheet led by the second separator 20 to the second sheet discharge tray 18, to discharge the sheet.

Hereinafter, a decoloring apparatus according to a second embodiment will be described. In the second embodiment, a configuration of a decoloring unit is different from that of the first embodiment. In the second embodiment, a heating member of the decoloring unit is supported by a rotatable rotary support. When the decoloring apparatus prohibits the decoloring processing by the decoloring unit, the rotary support rotates, and thereby the heating member moves to the above-described non-decoloring position. Further, a conveying roller is fitted to the rotary support. When the heating member is located at the non-decoloring position, in order to convey a sheet, the conveying roller, in place of the heating member, comes in contact with the sheet. In other words, the heating member and the conveying roller are exchanged in accordance with the rotation operation of the rotary support, and thereby the decoloring apparatus can switch the execution of the decoloring processing and the prohibition of the decoloring processing by the decoloring unit.

Specifically, the decoloring apparatus 1 according to the second embodiment has conveying guides 65, 66, a decoloring unit 50 and a shutter unit 60, in the same way as the first embodiment. Further, the decoloring apparatus 1 according to the second embodiment has the configuration shown in FIG. 1 and FIG. 4 in the same way as the first embodiment, and performs the control operation of the decoloring processing shown in FIG. 5.

Figure 6:
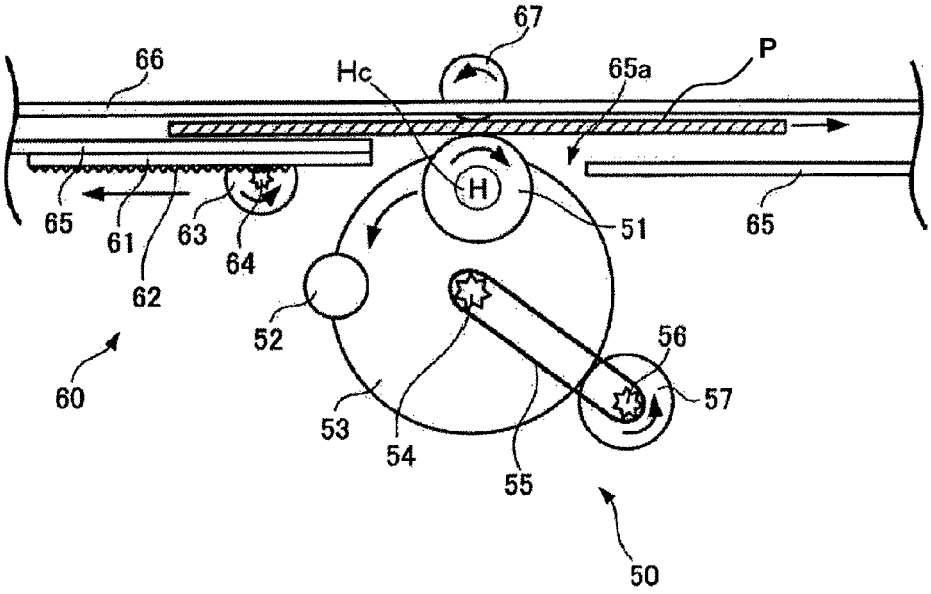
FIG. 6 is a diagram showing a decoloring unit and a shutter unit, when a decoloring apparatus according to a second embodiment executes a decoloring processing.
Figure 7:
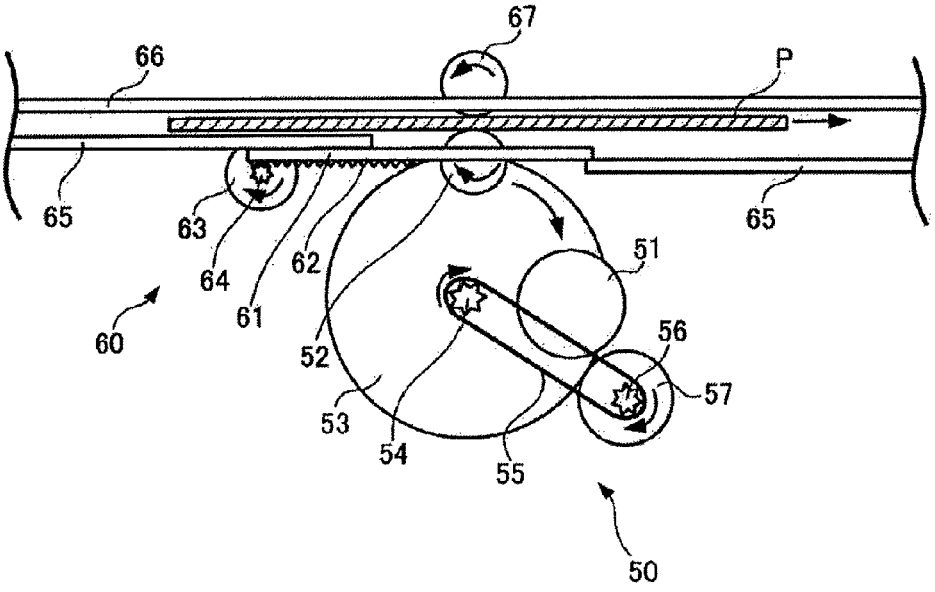
FIG. 7 is a diagram showing the decoloring unit and the shutter unit, when the decoloring apparatus according to the second embodiment prohibits the decoloring processing.
Figure 8:
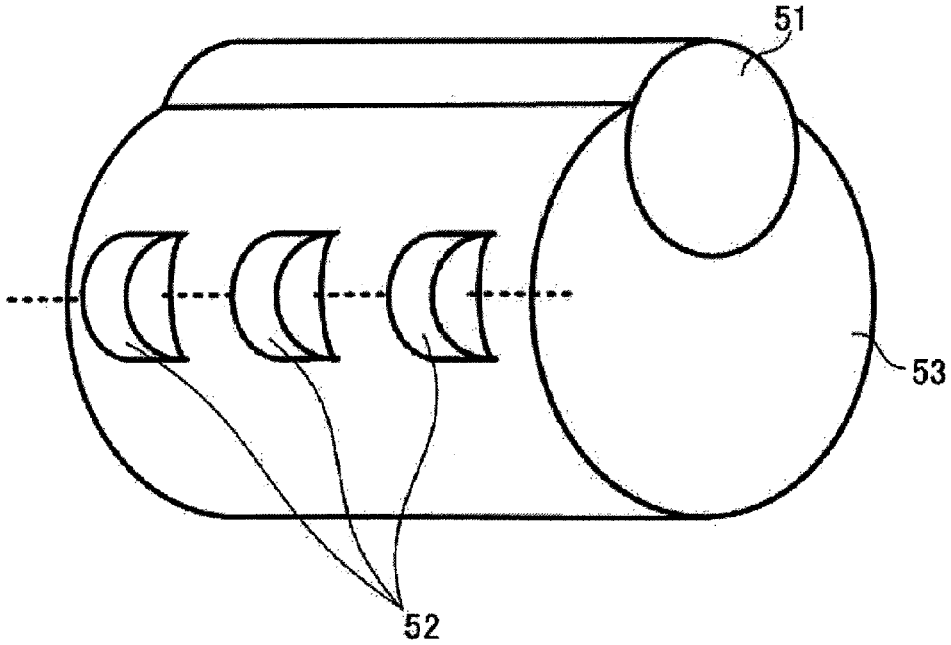
FIG. 8 is a perspective view showing the rotary support to support the heating member of the decoloring apparatus according to the second embodiment.
Figure 9:
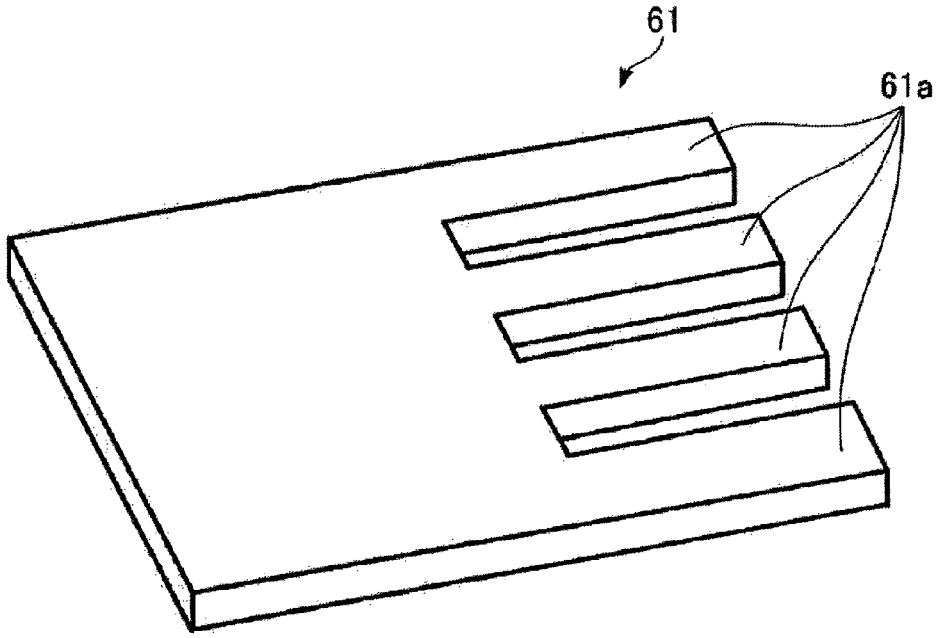
FIG. 9 is a perspective view showing the shutter of the decoloring apparatus according to the second embodiment.

Hereinafter, the configuration different from the first embodiment, in the decoloring apparatus 1 according to the second embodiment, will be described with reference to FIG. 6 to FIG. 9. FIG. 6 is a diagram showing the decoloring unit 50 and the shutter unit 60, when the decoloring apparatus 1 executes the decoloring processing. When the decoloring apparatus 1 executes the decoloring processing, a shutter 61 opens an opening 65 *a*, and a heating member 51 is located at the above-described decoloring position, as described later. FIG. 7 is a diagram showing the decoloring unit 50 and the shutter unit 60, when the decoloring apparatus 1 prohibits the decoloring processing. When the decoloring apparatus 1 prohibits the decoloring processing, the shutter 61 shields the opening 65*a*, and the heating member 51 is located at the above-described non-decoloring position, as described later. FIG. 8 is a perspective view showing the rotary support 53 of a contact/separation mechanism 57. FIG. 9 is a perspective view showing the shutter 61.

As shown in FIG. 6 and FIG. 7, the decoloring unit 50 is provided only at the conveying guide 65 side, and is not provided at the conveying guide 66 side. Accordingly, the conveying guide 65 has the opening 65*a* which the heating member 51 passes through, in the same manner as the first embodiment, but the conveying guide 66 does not have an opening. Further, instead of that the decoloring unit 50 is not provided at the conveying guide 66 side, a conveying roller 67 is provided as a part of the second sheet conveying unit 15. The conveying roller 67 is provided at the conveying guide 66 side, and thereby conveys the sheet P within the conveying guides 65, 66, in cooperation with a conveying roller 52 described later or the heating member 51. Hereinafter, the conveying roller 52 described later is called the first conveying roller 52, and the conveying roller 67 is called the second conveying roller 67. On the other hand, the decoloring unit 50 has the heating member 51 and the contact/separation mechanism 57. The contact/separation mechanism 57 has the first conveying roller 52, the rotary support 53, pinions 54, 56, and a belt 55.

The heating member 51 includes a heating roller which is rotatably supported to the rotary support 53 of the contact/separation mechanism 57. The rotary shaft of the heating roller is provided in parallel with the rotary shaft of the rotary support 53. The heating roller of the heating member 51 rotates by a driving force of a drive motor not shown. The heating member 51 reciprocates between the above-described decoloring position and the above-described non-decoloring position, in the same manner as the first embodiment. The heating member 51 rotates the heating roller while making it contact the sheet P at the decoloring position, and thereby heats the sheet P, while conveying the sheet P in cooperation with the second conveying roller 67. Specifically, as shown in FIG. 6, when the decoloring apparatus 1 executes the decoloring processing by the decoloring unit 50, the heating roller of the heating member 51 rotates, while being in contact with the sheet P to be conveyed within the conveying guides 65, 66, through the opening 65*a* of the conveying guide 65. The heating roller of the heating member 51 has a heat source Hc inside. The heat source Hc generates heat in the heating roller of the heating member 51, to transmit the heat to a surface of the heating roller which is in contact with the above-described sheet P. The heating roller of the heating member 51 heats an image formed on the sheet P, to a prescribed decoloring temperature, by the heat of the heat source Hc. On the other hand, the heating member 51 separates from the sheet P at the non-decoloring position, as shown in FIG. 7.

The first conveying roller 52 has a plurality of rollers, for example. The plurality of first conveying rollers 52 are supported to the rotary support 53 of the contact/separation mechanism 57, in the same manner as the heating member 51. The plurality of first conveying rollers 52 rotate around the same rotary shaft. The rotary shaft of the first conveying rollers 52 is provided in parallel with the rotary shaft of the rotary support 53. Accordingly, as shown in FIG. 8, the plurality of first conveying rollers 52 are arranged on the rotary support along the direction of the rotary shaft of the rotary support 53. Further, the plurality of first conveying rollers 52 are arranged on the rotary support 53 with a prescribed gap provided therebetween. The plurality of first conveying rollers 52 rotate by a driving force of a drive motor not shown. When the heating member 51 is located at the above-described non-decoloring position, the first conveying roller 52, in place of the heating member 51, enters within the conveying guides 65, 66, and thereby moves to a conveying position so as to conveying the sheet P. The conveying position is a position where the first conveying roller is opposite to the second conveying roller 67. The first conveying roller 52 rotates while being in contact with the sheet P at the conveying position, to convey the sheet P in cooperation with the second conveying roller 67. Specifically, as shown in FIG. 7, the first conveying roller 52 rotates while being in contact with the sheet P to be conveyed within the conveying guides 65, 66, through the opening 65*a* of the conveying guide 65. On the other hand, when the heating member 51 is located at the above-described decoloring position, the first conveying roller 52 retracts to the outside of the conveying guides 65, 66, and thereby moves to the non-conveying position not opposite to the second conveying roller 67. In other words, in accordance with that the heating member 51 reciprocates between the decoloring position and the non-decoloring position, the first conveying roller 52 reciprocates between the conveying position and the non-conveying position.

The rotary support 53 supports the heating member 51 and the plurality of first conveying rollers 52, and rotates forward and reversely. Specifically, the rotary shaft of the rotary support 53 is provided so that it is orthogonal to the sheet conveying direction, and also in parallel with the surface of the sheet P to be conveyed within the conveying guides 65, 66. Further, as shown in FIG. 8, the rotary support 53 supports the rotary shaft of the heating member 51 and the rotary shaft of the first conveying rollers 52, so that a part of the heating member 51 and parts of the first conveying rollers 52 project from the outer circumferential surface of the rotary support 53. The rotary support 53 rotates forward and reversely, to make a part of the heating member 51 and parts of the first conveying rollers 52 project at the different positions of the outer circumferential surface, so that one of the heating member 51 and the first conveying rollers 52 comes in contact with the sheet P.

Hereinafter, a rotation operation of the rotary support 53, and a movement operation of the heating member 51 and the first conveying rollers 52 accompanied by this rotation operation will be described. The contact/separation mechanism 57 rotates the rotary support 53, using the pinions 54, 56 and the belt 55. The pinion 56 is fitted to the driving unit of the contact/separation mechanism 57. The pinion 54 is fitted to the rotary support 53. The belt 55 is wound around the pinion 54 and the pinion 56, in the state that the belt 55 is engaged with the pinion 54 and the pinion 56. The contact/separation mechanism 57 rotates the pinion forward and reversely, so as to make the heating member 51 reciprocate between the above-described decoloring position and the above-described non-decoloring position. When the contact/separation mechanism 57 rotates the pinion 54, the driving force of the contact/separation mechanism 57 is transmitted to the belt 55 as the rotating force of the pinion 54. The driving force of the contact/separation mechanism 57 is transmitted to the belt 55, and thereby the belt 55 also rotates. When the belt 55 rotates, the driving force of the contact/separation mechanism 57 is transmitted to the pinion 56 as the rotating force of the belt 55. The driving force of the contact/separation mechanism 57 is transmitted to the pinion 56, and thereby the pinion 56 rotates. The pinion 56 rotates, and thereby the rotary support 53 rotates. In other words, the contact/separation mechanism 57 transmits the driving force to the rotary support 53, via the pinions 54, 56 and the belt 55, to rotate the rotary support 53. The rotary support 53 rotates, to reciprocate the heating member 51 between the decoloring position and the non-decoloring position. The description of the decoloring position and the non-decoloring position is as described above. Further, the rotary support 53 rotates, to reciprocate the first conveying roller 52 between the above-described conveying direction and the above-described non-conveying direction.

Hereinafter, an operation of the shutter 61 of the shutter unit 60 to open and close the opening 65*a* of the conveying guide 65 will be described. The shutter unit 60 has the shutter 61 and a driving mechanism 63, in the same way as the first embodiment. The shutter 61 is slidably supported to the conveying guide 65, and reciprocates between the above-described open position and the above-described shielding position. The shutter 61 opens and closes the above-described opening 65*a* of the conveying guide 65 by this reciprocal motion. The driving mechanism 63 has a rack 62 and a pinion 64, in the same way as the first embodiment. The rack 62 is fitted to the shutter 61. The pinion 64 is fitted to the driving unit of the driving mechanism 63. The rack 62 and the pinion 64 are engaged with each other. The driving mechanism 63 rotates the pinion 64, to transmit the driving force to the rack 62. When the driving force of the driving mechanism 63 is transmitted to the rack 62, the shutter 61 reciprocates between the open position and the shielding position. The description of the open position and the shielding position is as described above.

Hereinafter, an operation of the decoloring apparatus 1 to execute the decoloring processing by the decoloring unit 50 will be described. As shown in FIG. 6, when the decoloring apparatus 1 executes the decoloring processing by the decoloring unit 50, the shutter 61 is located at the above-described open position to open the opening 65, and the heating member 51 is located at the above-described decoloring position. Specifically, the driving mechanism 63 rotates the pinion 64, to move the shutter 61 to the open position. When the shutter 61 is located at the open position, since the opening 65*a* formed in the conveying guide 65 is opened, the heating member 51 becomes possible to move to the decoloring position. After the shutter 61 has opened the opening 65*a*, the contact/separation mechanism 57 rotates the pinion 56, to rotate the rotary support 53. The rotary support 53 rotates, to move the heating member 51 to the decoloring position. The heating member 51 comes in contact with the sheet P to be conveyed within the conveying guides 65, 66, to pressurize the sheet P with the second conveying roller 67. The heating member 51 heats an image of the sheet P, while conveying the sheet P in cooperation with the second conveying roller 67. The heating member 51 heats the image of the sheet P, to perform the decoloring processing. The second conveying roller 67 is arranged at a position opposite to the heating member 51 located at the decoloring position. On the other hand, when the heating member 51 moves to the decoloring position, the first conveying roller 52 moves to the non-decoloring position as described above.

Hereinafter, an operation of the decoloring apparatus 1 to convey the sheet P, while prohibiting the decoloring processing by the decoloring unit 50 will be described. As shown in FIG. 7, when the decoloring apparatus 1 prohibits the decoloring processing by the decoloring unit 50, the shutter is located at the above-described shielding position to shield the opening 65*a*, and the heating member 51 is located at the above-described non-decoloring position. Specifically, the contact/separation mechanism 57 rotates the rotary support 53 using the pinions 54, 56, and the belt 55, to move the heating member 51 to the non-decoloring position. The contact/separation mechanism 57 moves the heating member 51 to the non-decoloring position, and in addition, moves the first conveying roller 52 to the above-described conveying position. The first conveying roller 52 rotates while being in contact with the sheet P at the conveying position, to convey the sheet P in cooperation with the second conveying roller 67.

Hereinafter, when the decoloring apparatus 1 prohibits the decoloring processing by the decoloring unit 50, an operation of the shutter 61 of the shutter unit 60 to shield the opening 65*a* of the conveying guide 65 will be described. When the decoloring apparatus 1 prohibits the decoloring processing of the decoloring unit 50, the driving mechanism 63 rotates the pinion 64, to move the shutter 61 to the above-described shielding position. The shutter 61 has a shape not to interfere with the first conveying roller 52, at the shielding position. The shutter 61 is formed in a comb-teeth shape, for example. Accordingly, the shutter 61 located at the shielding position does not come in contact with the first conveying roller 52 located at the conveying position.

The shape of the shutter 61 will be further described with reference to FIG. 9. As shown in FIG. 9, the shutter 61 is formed in a comb-teeth shape. Specifically, the shutter 61 has a plurality of comb teeth 61*a* extending in the sheet conveying direction. The plurality of comb teeth 61*a* are formed in the shutter 61 with a prescribed gap provided therebetween. The first conveying rollers 52 project from between the comb teeth 61*a*, and enter within the conveying guides 65, 66, to move to the conveying position. Accordingly, the first conveying rollers 52 can convey the sheet P at the conveying position, without coming in contact with the shutter 61 located at the above-described shielding position.

The heat source Hc, the contact/separation mechanism 57 and the driving mechanism 63 are controlled by the controller 21, in the same manner as the first embodiment.

Figure 10:
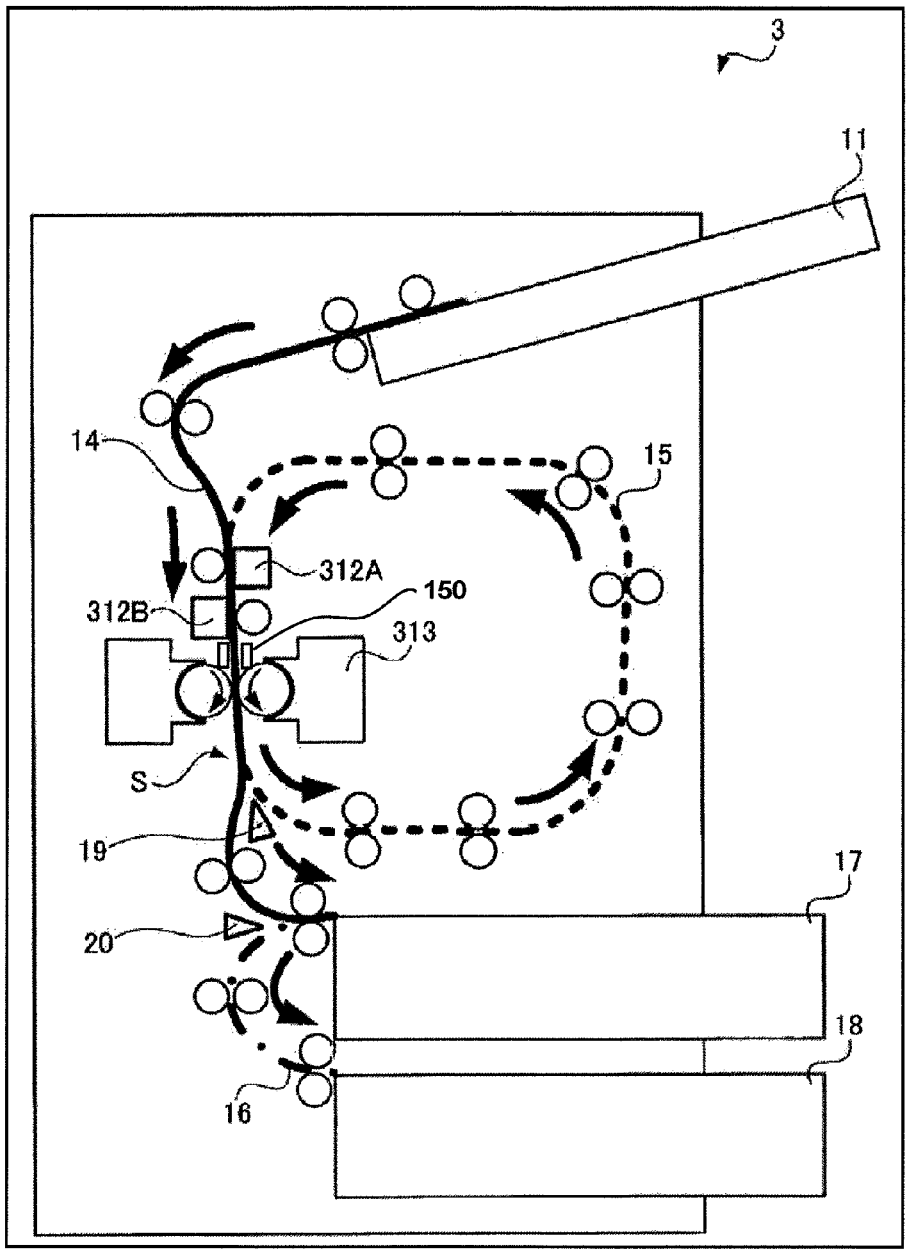
FIG. 10 is a sectional view showing a main portion of a decoloring apparatus according to a third embodiment.

Hereinafter, a decoloring apparatus according to a third embodiment will be described with reference to FIG. 10. The decoloring apparatus according to the third embodiment is different from the above-described first embodiment, in the arrangement position of the image read sensor, and the arrangement positions of the shutter unit and the decoloring unit. FIG. 10 is a sectional view showing a main portion of the decoloring apparatus according to the third embodiment.

Since in a decoloring apparatus 3 according to the third embodiment shown in FIG. 10, portions other than the arrangement of image read sensors 312A, 312B, the shutter unit 150 and a decoloring unit 313 are the same as the portions in the first embodiment, the same symbols are given to the same portions, and thereby the detailed description will be omitted.

As shown in FIG. 10, the decoloring apparatus 3 has the two image read sensors 312A, 312B, in the same way as the first embodiment. The image read sensors 312A, 312B are arranged along the first conveying path of the first sheet conveying unit 14, and at positions not opposite to each other at both sides of the first conveying path. In other words, the positions of the image read sensors 312A, 312B are different in the sheet conveying direction of the first conveying path. The image read sensor 312A is arranged at a more upstream side of the first conveying path in the sheet conveying direction than the image read sensor 312B.

Further, the decoloring apparatus 3 has the shutter unit 150 and the decoloring unit 313. The shutter unit 150 and the decoloring unit 313 are arranged, in the first conveying path of the first sheet conveying unit 14, at more downstream side in the sheet conveying direction than the image read sensors 312A, 312B. The shutter unit 150 and the decoloring unit 313 have the same configurations as those in the first embodiment, but the configuration thereof are not necessarily limited to these configurations. As the decoloring unit 313, the decoloring unit 50 in the second embodiment may be adopted, for example.

The decoloring apparatus 3 according to the third embodiment has a compact configuration, so as to make an installation space (a space in the horizontal direction in FIG. 10) in an office narrow, for example. Accordingly, a space inside the decoloring apparatus 3 becomes narrower, and thereby the arrangement of the components inside the decoloring apparatus 3 is limited. The decoloring apparatus 3 arranges the image read sensors 312A, 312B, the shutter unit 150 and the decoloring unit 313 linearly along the first sheet conveying unit 14 that is the same conveying unit, to realize the compactification of the apparatus.

However, in the decoloring apparatus 3 having a compact configuration as described above, a sheet which passes through the image read sensors 312A, 312B inevitably passes through the decoloring unit 313, as will be described later.

Accordingly, when an enough time has not elapsed after the previous decoloring processing, for example, there is a possibility that the decoloring processing might be performed to a sheet passing through the decoloring unit 313, by the residual heat of the decoloring unit 313.

In contrast, the decoloring apparatus 3 adopts the decoloring unit 13 in the first embodiment as the decoloring unit 313, as described above. Accordingly, the decoloring apparatus 3 can selectively execute or prohibit the decoloring processing to a sheet passing through the decoloring unit 313. Specifically, the decoloring apparatus 3 conveys a sheet to be fed from the sheet feeding unit 11 to the image read sensors 312A, 312B, using the first sheet conveying unit 14 in the same manner as the first embodiment. The image read sensors 312A, 312B read an image of the sheet, in the same manner as the first embodiment. The first sheet conveying unit 14 further conveys the sheet which passes through the image read sensors 312A, 312B to the decoloring unit 313. Accordingly, the sheet which passes through the image read sensors 312A, 313B inevitably passes through the decoloring unit 313, and at this time, the decoloring apparatus 3 prohibits the decoloring processing by the decoloring unit 313, using the contact/separation mechanisms 133A, 133B and the shutter unit 150, in the same manner as the first embodiment. Further, the decoloring apparatus 3 returns the sheet to the more upstream position than the image read sensors 312A, 312B in the first conveying path of the first sheet conveying unit 14, using the first separator 19 and the second sheet conveying unit 15, in the same manner as the first embodiment. The decoloring apparatus 3 conveys the sheet to the image read sensors 312A, 312B and the decoloring unit 313 again, using the first sheet conveying unit 14. When the sheet is conveyed again to the image read sensors 312A, 312B and the decoloring unit 313, the image read sensors 312A, 313B do not perform the reading operation. On the other hand, the decoloring apparatus 3 executes the decoloring processing to the sheet, using the contact/separation mechanisms 133A, 133B and the shutter unit 150, in the same manner as the first embodiment. The decoloring apparatus 3 discharges the sheet after the decoloring processing to any of the first sheet discharge tray 17 and the second sheet discharge tray 18, using the first sheet conveying unit 14, the first separator 19, the second separator 20 and the third conveying unit 16, in the same manner as the first embodiment.

Each of the decoloring apparatuses according to the first and third embodiments described above linearly moves the support of the contact/separation mechanism, and thereby can move the heating member to the above-described non-decoloring position. Accordingly, when an image of a sheet to be conveyed to the decoloring unit is a confidential document, for example, the decoloring apparatus can prohibit the decoloring processing to the sheet to be conveyed to the decoloring unit. On the other hand, the decoloring apparatus linearly moves the support of the contact/separation mechanism, and thereby can move the heating member from the non-decoloring position to the above-described decoloring position. Accordingly, when an image of a sheet to be conveyed to the decoloring unit is not a confidential document, for example, the decoloring apparatus can perform the decoloring processing to the sheet to be conveyed to the decoloring unit.

Further, each of the decoloring apparatuses of the first and third embodiments can move the shutter to the above-described shielding position, along with the moving of the above-described heating member. Accordingly, it is possible to prevent that the heat generated by the heating member is transmitted to the sheet to be conveyed to the decoloring unit. For example, even when the heating member has moved to the above-described non-decoloring position, the heat is transmitted from the heating member to the sheet through air. It is also thought that an image of the sheet is heated by this transmitted heat, and thereby the decoloring processing might be performed to the image of the sheet. In contrast, the decoloring apparatus can shield between the heating member and the sheet to be conveyed to the decoloring unit 13 by the shutter. Accordingly, the decoloring apparatus can more surely prevent that the heat is transmitted to the sheet, to cause the sheet to be heated.

In each of the first to third embodiments, the heating member includes a roller having a heat source inside, but the heating member is not necessarily limited to this. The heating member may include a plate-like ceramic heater, for example.

Each of the decoloring apparatuses according to the first and third embodiments heats the sheet to be conveyed to the decoloring unit while pressurizing the sheet, using the two heating members, to perform the decoloring processing, but it is not necessarily required that the number of the heating members is two. For example, the decoloring apparatus may heat the sheet to be conveyed to the decoloring unit while pressurizing the sheet, by one heating member and one conveying roller.

Further, in the decoloring apparatus according to the second embodiment, the rotary support of the contact/separation mechanism rotates, and thereby the decoloring apparatus can move the heating member from the above-described decoloring position to the above-described non-decoloring position. Accordingly, when an image of the sheet to be conveyed to the decoloring unit is a confidential document, for example, the decoloring apparatus can prohibit the decoloring processing to the sheet. Further, since the decoloring apparatus moves the heating member to the non-decoloring position, and in addition, moves the shutter to the above-described shielding position, it is possible to prevent that the heat generated by the heating member is transmitted to the sheet.

In the second embodiment, the rotary support is formed in a roll shape. The rotary support has a gentle curve near a position on the outer circumferential surface where the heating member is arranged. Further, the rotary support is arranged so that a gap is not preferably generated with the conveying guide. Accordingly, the above-described curve of the rotary support plays the role of the conveying guide of the sheet, to prevent that the sheet to be conveyed is jammed in the conveying path. In other words, the rotary support plays the role of the conveying guide of the sheet, to prevent a sheet jam (so called a jam).

In the second embodiment, the shutter is formed in a comb-teeth shape, but the shape of the shutter is not necessarily limited to this. Holes from which the conveying rollers can project may be formed in the shutter. The shutter has only to be formed in a shape such that the conveying rollers can project within the conveying guides, and even when the shutter is located at the shielding position, the sheet can be conveyed by the conveying rollers.

Each of the decoloring apparatuses according to the first and second embodiment, when having determined that an image of a sheet is a confidential document, based on the read result by the image read sensor, prohibits the decoloring processing by the decoloring unit, but it is not necessarily required that the image of the sheet is a confidential document. Each of the decoloring apparatuses according to the first and second embodiment, even when having received an instruction input of the prohibition of the decoloring processing by a user, for example, have only to prohibit the decoloring processing to a sheet when it is necessary for the sheet to pass through the decoloring unit.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A decoloring apparatus comprising:

a sheet conveying unit to convey a sheet on which an image is formed;

a heating member to heat the image, so as to decolor the image formed on the sheet to be conveyed by the sheet conveying unit;

a contact/separation mechanism to move the heating member between a decoloring position where the heating member heats the image and a non-decoloring position distant from the decoloring position;

a shutter which is interposed between the sheet to be conveyed by the sheet conveying unit and the heating member, to prevent that heat of the heating member is transmitted to the sheet;

a driving mechanism to move the shutter between a shielding position where the heat transmission is prevented and an open position distant from the shielding position; and a controller which controls the contact/separation mechanism, to make the heating member to be moved to the non-decoloring position, and then controls the driving mechanism, to make the shutter to be moved to the shielding position.

2. The decoloring apparatus according to claim 1, wherein:

the sheet conveying unit has a conveying guide which guides the sheet to be conveyed, and is formed with an opening to expose the sheet to be conveyed; and the heating member enters within the conveying guide from the opening, to move to the decoloring position, and is retracted from the opening to the outside of the conveying guide, to move to the non-decoloring position.

3. The decoloring apparatus according to claim 2, wherein the heating member comes in contact with the sheet within the conveying guide at the decoloring position, and separates from the sheet within the conveying guide at the non-decoloring position.

4. The decoloring apparatus according to claim 3, wherein the shutter is interposed between the sheet to be conveyed and the heating member at the opening, to prevent that the heat of the heating member is transmitted to the sheet.

5. The decoloring apparatus according to claim 4, wherein the shutter shields at least a part of the opening at the shielding position, to prevent that the heating member comes in contact with the sheet, and opens the opening at the open position, to allow that the heating member moves to the decoloring position.

6. The decoloring apparatus according to claim 5, wherein the contact/separation mechanism linearly moves the heating member between the decoloring position and the non-decoloring position.

7. The decoloring apparatus according to claim 6, wherein the contact/separation mechanism has a support which supports the heating member and is linearly movable, and moves the support in a direction orthogonal to a sheet conveying direction, to move the heating member between the decoloring position and the non-decoloring position.

8. The decoloring apparatus according to claim 7, wherein;

the heating member includes a heating roller which is rotatably supported to the support; and the heating roller rotates while being in contact with the sheet, to convey the sheet while heating the sheet.

9. The decoloring apparatus according to claim 5, wherein the contact/separation mechanism nonlinearly moves the heating member between the decoloring position and the non-decoloring position.

10. The decoloring apparatus according to claim 9, wherein the contact/separation mechanism has a rotary support which supports the heating member and is rotatable, and rotates the rotary support around a rotary shaft which is orthogonal to a sheet conveying direction and in parallel with a surface of the sheet, to move the heating member between the decoloring position and the non-decoloring position.

11. The decoloring apparatus according to claim 10, wherein:

the contact/separation mechanism has a conveying roller to convey the sheet when the heating member is located at the non-decoloring position, the heating member includes a heating roller which conveys the sheet at the decoloring position while heating the sheet; and the rotary support supports the heating roller and the conveying roller.

12. The decoloring apparatus according to claim 11, wherein the contact/separation mechanism rotates the rotary support, and thereby while moving the heating roller from the inside of the conveying guide to the non-decoloring position via the opening, makes the conveying roller enter within the conveying guide via the opening.

13. The decoloring apparatus according to claim 12, wherein the shutter has a shape in which the shutter does not interfere with the conveying roller entering within the conveying guide, when the shutter is located at the shielding position.

14. The decoloring apparatus according to claim 13, wherein the controller controls the contact/separation mechanism when the shutter is located at the shielding position, to make the conveying roller enter within the conveying guide so as to convey the sheet.

15. The decoloring apparatus according to claim 14, wherein:

the rotary support supports a plurality of the conveying rollers along a direction of the rotary shaft;

the shutter has a shape including comb teeth extending in the sheet conveying direction; and the plurality of the conveying rollers enter within the conveying guide from between the comb teeth, when the shutter is located at the shielding position.

16. The decoloring apparatus according to claim 1, wherein the controller controls the driving mechanism, to make the shutter to be moved to the open position, and then controls the contact/separation mechanism, to make the heating member to be moved to the decoloring position.

17. The decoloring apparatus according to claim 16, further comprising an image read sensor to read the image formed on the sheet, wherein the controller controls the contact/separation mechanism so as to move the heating member, based on data of the image read by the image read sensor, and controls the driving mechanism so as to move the shutter.

* * * * *